US010767366B1

(12) United States Patent
Bryan

(10) Patent No.: US 10,767,366 B1
(45) Date of Patent: Sep. 8, 2020

(54) BUILDING ELEMENT AND METHOD

(71) Applicant: Steve Bryan, Nashville, TN (US)

(72) Inventor: Steve Bryan, Nashville, TN (US)

( * ) Notice: Subject to any disclaimer, the term of this patent is extended or adjusted under 35 U.S.C. 154(b) by 155 days.

(21) Appl. No.: 15/633,852

(22) Filed: Jun. 27, 2017

Related U.S. Application Data

(63) Continuation-in-part of application No. 13/602,439, filed on Sep. 4, 2012, now Pat. No. 9,688,049, which is a continuation of application No. 12/193,038, filed on Aug. 17, 2008, now Pat. No. 8,256,186.

(60) Provisional application No. 60/956,462, filed on Aug. 17, 2007.

(51) Int. Cl.
*E04C 3/18* (2006.01)
*E04B 2/70* (2006.01)

(52) U.S. Cl.
CPC ..... *E04B 2/702* (2013.01); *E04C 3/18* (2013.01)

(58) Field of Classification Search
CPC ..... B32B 15/10; B32B 2419/00; B32B 3/10; E04B 1/08; E04B 1/10; E04B 1/24; E04B 2/58; E04B 2/60; E04B 2/62; E04B 2/702; E04B 2001/26; E04B 2001/2604; E04B 2001/2692; E04C 3/127; E04C 3/292; E04C 3/18; E04C 3/122; E04C 2/24; E04C 2/26; E04C 2/28; E04C 2/36
See application file for complete search history.

(56) References Cited

U.S. PATENT DOCUMENTS 1,285,458 A * 11/1918 Strunk ..... B65D 90/026 217/4
2,563,703 A * 8/1951 Bonney ..... E04B 2/702 52/233
4,688,362 A * 8/1987 Pedersen ..... E04B 2/08 52/223.7
4,823,528 A * 4/1989 Faw ..... E04B 2/702 52/233
6,244,009 B1 * 6/2001 Cerrato ..... E04B 2/08 52/223.7
6,247,286 B1 * 6/2001 Heyns ..... E04C 2/296 52/589.1
2007/0137122 A1 * 6/2007 Peaco ..... E04B 1/10 52/233

* cited by examiner

*Primary Examiner* — Jessica L Laux
(74) *Attorney, Agent, or Firm* — Wayne Edward Ramage; Baker Donelson

(57) ABSTRACT

A formed building element or "log" comprising a top filler section and a bottom filler section affixed on opposite sides of a center reinforcement member. The center reinforcement member may be a steel or metal rod or tube. The reinforcement member, which may be of approximately the same length of the filler sections, has one end extending out from the end of the building element. The extended end may have a vertical hole extending from top to bottom, adapted to accept a rod pin, which may or may not be threaded. Matching holes extend from the top to bottom of the filler section at the opposite end of the building element, so adjacent building elements may be attached end-to-end, and stacked vertically to form walls.

8 Claims, 13 Drawing Sheets

ALTERNATING LOGS ARE OFFSET AND STACKED AS SHOWN

BUILDING ELEMENT AND METHOD

This application is a continuation-in-part of U.S. application Ser. No. 13/602,439, filed Sep. 4, 2012, which is a continuation of U.S. application Ser. No. 12/193,038, filed Aug. 17, 2008, which claims priority to Provisional Patent Application No. 60/956,462, filed Aug. 17, 2007, entitled "Building Element and Method," and is entitled to those filing dates for priority in whole or in part. The complete disclosures, specifications, drawings and attachments of U.S. application Ser. Nos. 12/193,038 and 13/602,439 and Provisional Patent Application No. 60/956,462 are incorporated herein in their entireties by specific reference for all purposes.

FIELD OF INVENTION

This invention relates to a method of framing and constructing buildings by stacking formed building elements.

SUMMARY OF INVENTION

In one exemplary embodiment, the present invention generally provides a building element having a proximal end, a distal end, and a length between said proximal and distal ends, comprising a top filler section, a bottom filler section, and a reinforcement member, wherein the top filler section, bottom filler section, and reinforcement member each have first and second surfaces opposite and parallel to one another, third and fourth surfaces opposite and parallel to one another, and wherein the third and fourth surfaces are perpendicular to the first and second surfaces.

The first and second surfaces of the building element each describe a width and the third and fourth surfaces each describe a height, the top filler section, bottom filler section, and reinforcement member each have a length perpendicular to their height and width, and the top filler section, bottom filler section, and reinforcement member each have a proximal end at, approximately, the building element proximal end, and a distal end at, approximately, the building element distal end.

The top filler section second surface is affixed to the reinforcement member first surface, and the bottom filler section first surface is affixed to the reinforcement member second surface. The top and bottom filler sections may be of wood, compressed wood, wood pulp, artificial material, or other material known in the art to be used in place of wood, while the reinforcement member may be a metal rod or tube, preferably a steel tube.

In another embodiment, the reinforcement member, top filler section, and bottom filler section widths may be approximately equal to one another. The building element may then further comprise a side panel affixed to the reinforcement member third surface, the top filler section third surface, the bottom filler section third surface, any two of the third surfaces, or all three of the third surfaces. Optionally, the building element may further comprise a side panel affixed to the reinforcement member fourth surface, the top filler section fourth surface, the bottom filler fourth surface, any two of the fourth surfaces, or all three of the fourth surfaces.

In another embodiment, the top filler section and bottom filler section widths may be equal to one another but greater than the reinforcement member width. The building element may further comprise a side panel between the top filler section second surface and the bottom filler first surface, and affixed to at least the reinforcement member third surface.

Optionally, the building element may further comprise a side panel between the top filler section second surface and the bottom filler first surface, and affixed to at least the reinforcement member fourth surface.

In another embodiment of the present invention, the top filler section length, bottom filler section length, and reinforcement member length are all about the same as one another. In one aspect of this embodiment, the reinforcement member proximal end extends proximally of the top filler section and bottom filler section proximal ends, and the top filler section and bottom filler section distal ends extend distally of the reinforcement member distal end. In this aspect, the building element proximal end further comprises a hole proximal to the top filler section and bottom filler section proximal ends, perpendicular to the reinforcement member width, and extending from the reinforcement member first surface to the reinforcement member second surface. The building element distal end further comprises matched holes distal to the reinforcement member distal end, perpendicular to the top filler section and bottom filler section widths, and extending from the top filler section first surface to the top filler section second surface, and from the bottom filler section first surface to the bottom filler second surface.

In another embodiment of the present invention, the top filler section first surface further comprises a tongue extending upward for at least part of the top filler section length, and the bottom filler section second surface further comprises a groove extending for at least part of the bottom filler section length, wherein the tongue is adapted to be inserted into groove.

In yet another embodiment of the present invention, the reinforcement member is 2" wide and 4" high, and the top and bottom filler sections are each 4.5" wide and 4" high, the reinforcement member is made of steel tubing and the top and bottom filler sections are made of wood, the reinforcement member proximal end extends 4.5" beyond the proximal ends of the top and bottom filler proximal ends, and the top and bottom filler distal ends extend 4.5" distally beyond the distal end of the reinforcement member distal end. In another embodiment, the top filler section first surface further comprises a tongue extending for least part of the top filler section length, and the bottom filler section second surface further comprises a groove extending for at least part of the bottom filler section length.

DETAILED DESCRIPTION OF THE INVENTION

Figure 1:
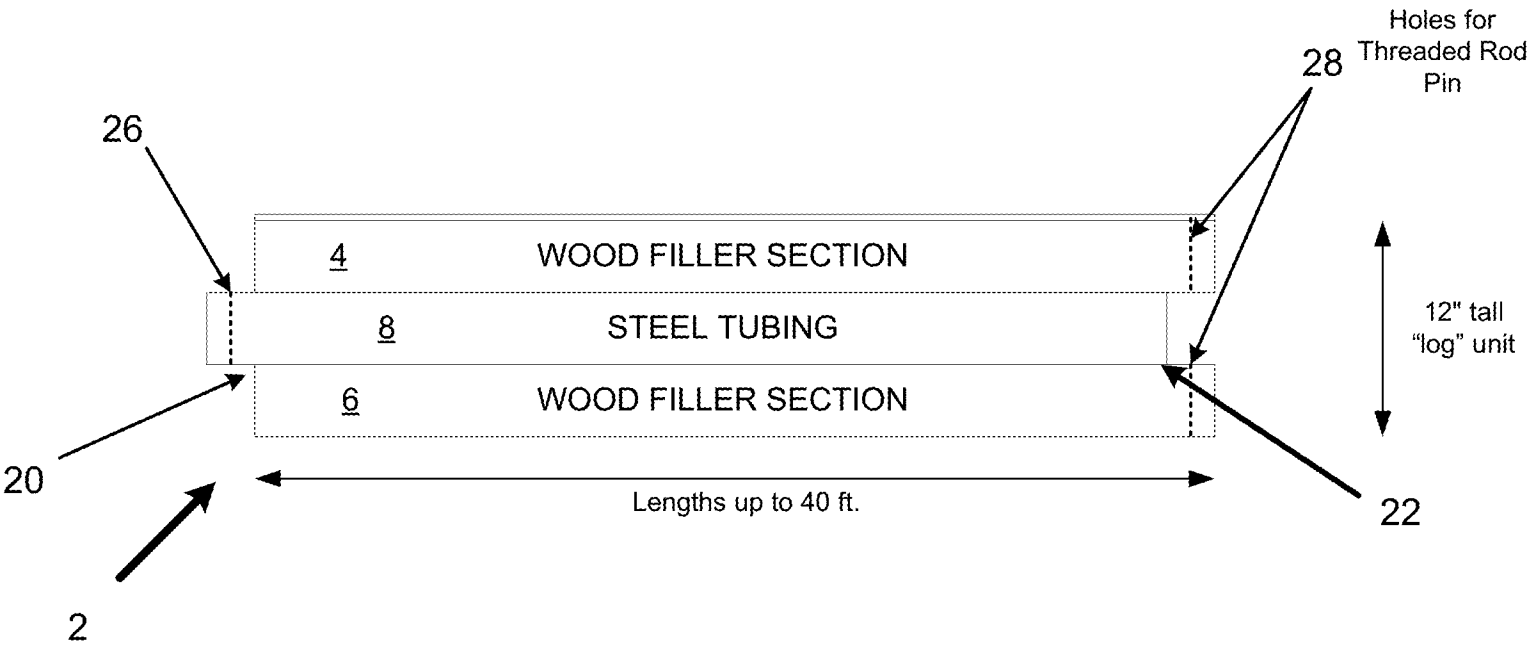
FIG. 1 shows a building element in accordance with one embodiment of the present invention.
Figure 2:
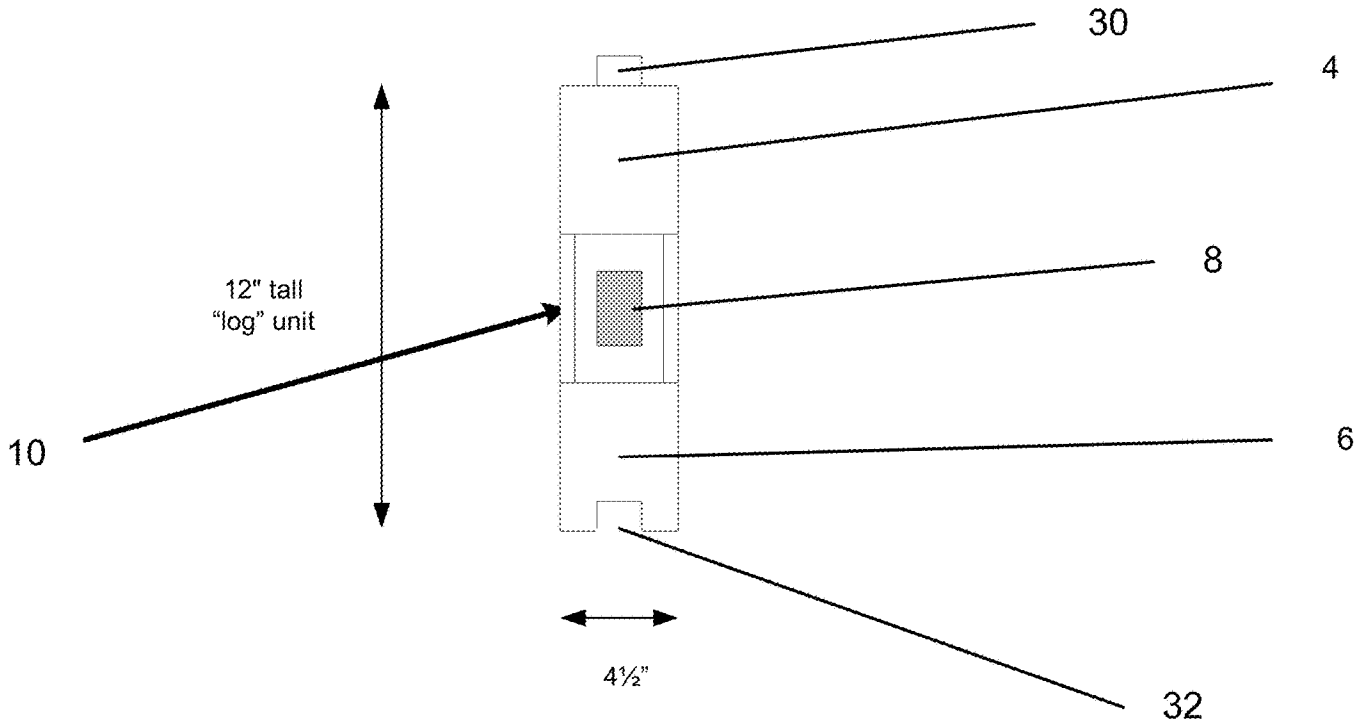
FIG. 2 shows a cross-section view of a building element in accordance with one embodiment of the present invention.

A formed building element (or "log") 2 is shown in FIGS. 1-4. The building element 2 comprises a top filler section 4 and a bottom filler section 6 affixed on opposite sides of a center reinforcement member 8. The filler sections 4, 6 may comprise wood, compressed wood or wood pulp, artificial material, or other material that is known in the art to be used in place of wood. The center reinforcement member 8 may be a steel or metal rod or tube, as shown in FIG. 1. The filler sections may be affixed to the center reinforcement member by any suitable means known in the art, including adhesives, glue, or bolting.

Figure 3:
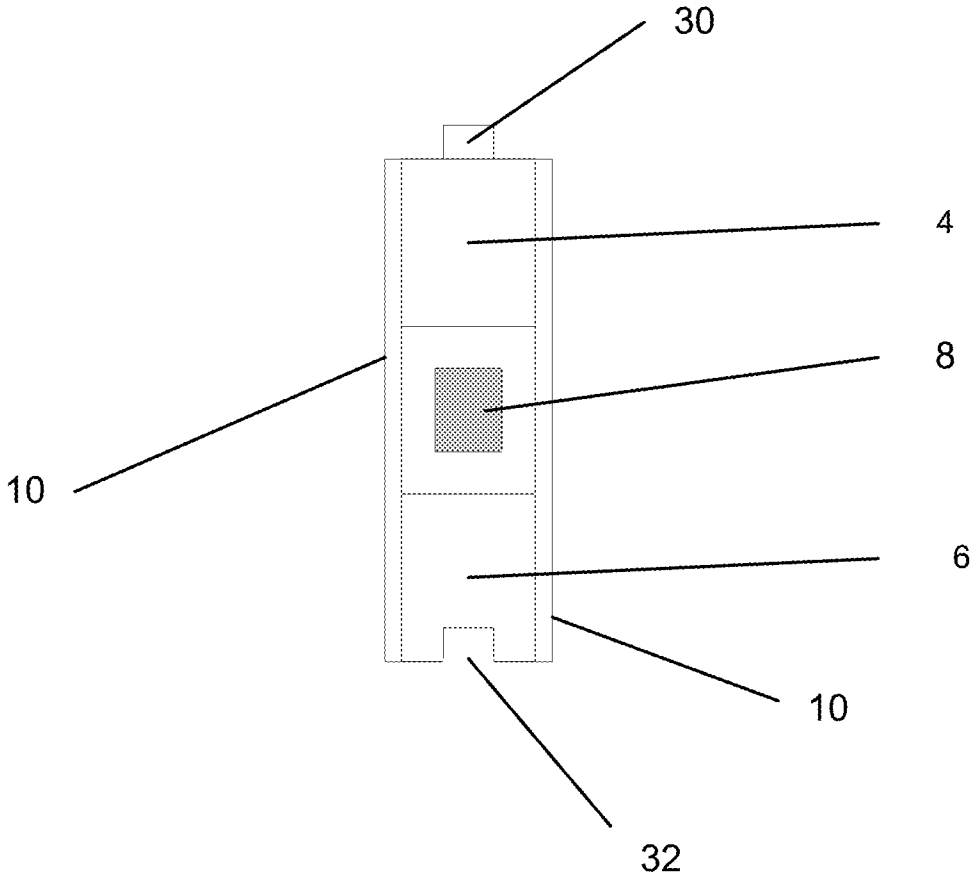
FIG. 3 shows a cross-section view of a building element in accordance with another embodiment of the present invention.
Figure 4:
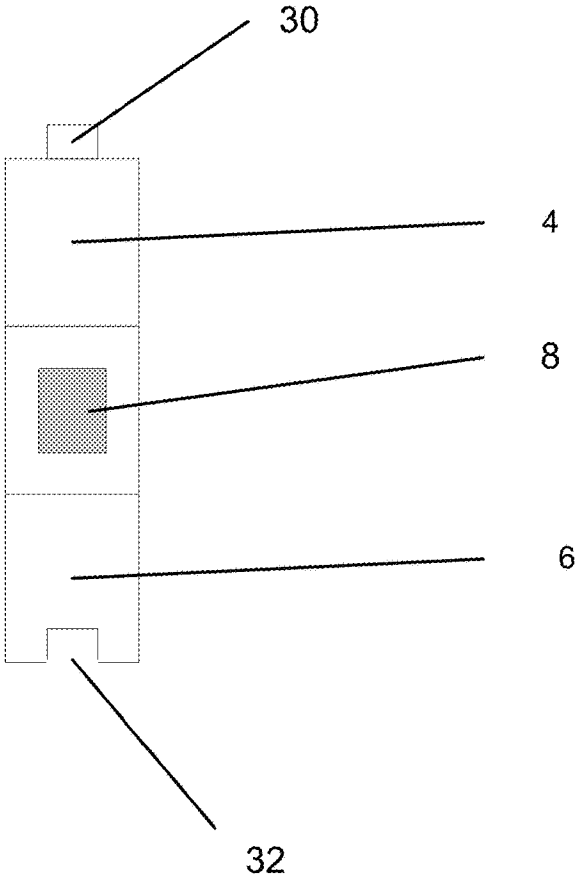
FIG. 4 shows a cross-section view of a building element in accordance with another embodiment of the present invention.

In one exemplary embodiment, the width of the center reinforcement member is the same width as the filler sections, so that the reinforcement member may be seen from the side, as seen in FIG. 3. In another exemplary embodiment, side panels 10 may be affixed to the sides of the building element. This allows other types of siding to be nailed, screwed, or otherwise affixed to the building. The side panels may extend for a portion of or the entire height of the building element as seen in FIG. 4. Alternatively, as shown in FIG. 1, the width of the center reinforcement member 8 may be slightly less than the width of the filler sections, and the side panels 10 of suitable height and depth to match the height of the center reinforcement member and be flush with the faces of the filler sections when inserted over and affixed to the reinforcement section.

Figure 7:
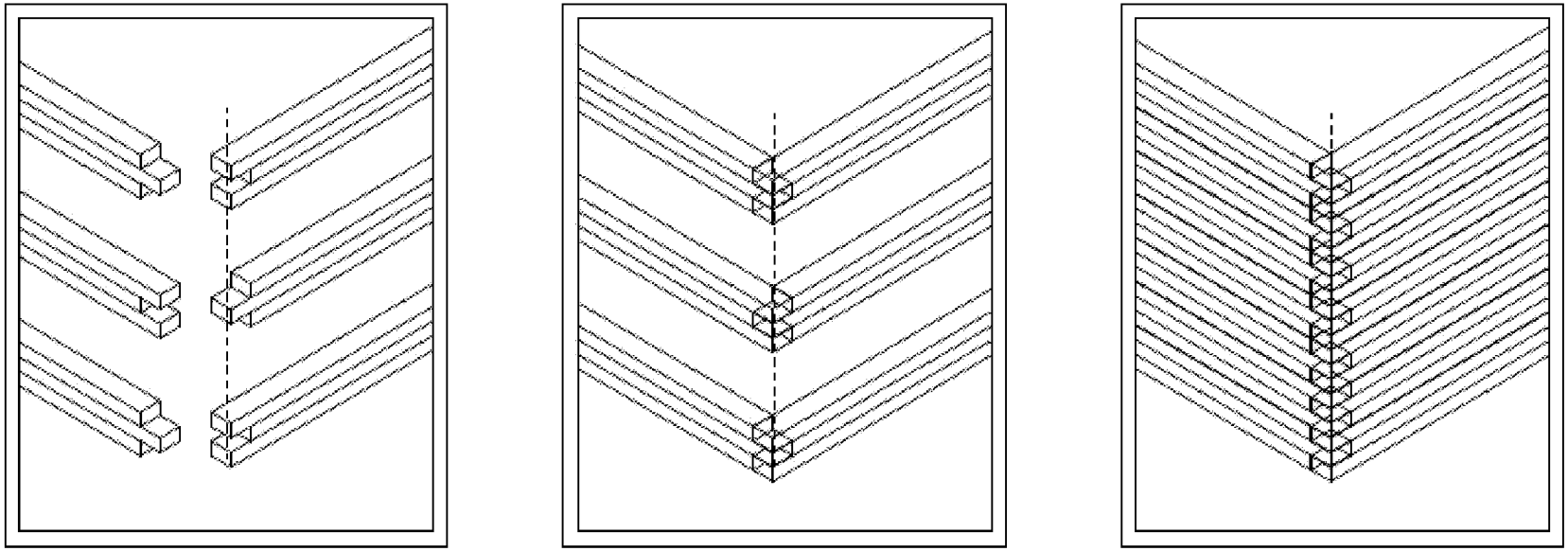
FIG. 7 shows a view of a corner between two adjacent walls.
Figure 8:
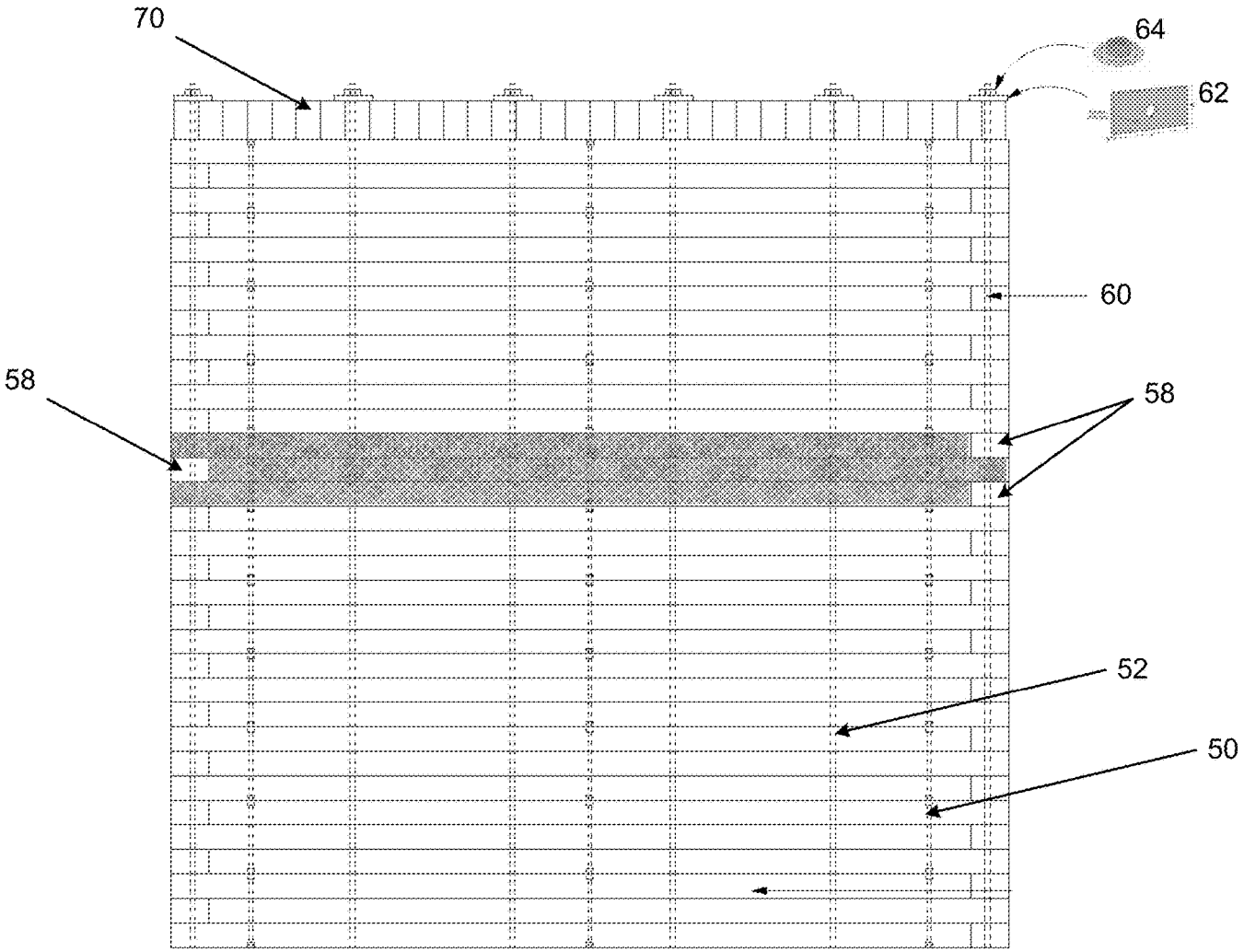
FIG. 8 shows a side view of a wall with reinforcing rods.

In one exemplary embodiment, the reinforcement member, which may be of approximately the same length of the filler sections, has one end 20 extending out from the end of the building element, with the other end 22 withdrawn inside the building element. The extended end 20 may have a vertical hole 26 extending from top to bottom, adapted to accept a rod pin, which may or may not be threaded. Matching holes 28 extend from the top to bottom of the filler section at the opposite end of the building element. This construction enables adjacent building elements to be attached end-to-end, with the extended end 20 inserted into the space in the corresponding opposite end of the adjacent building element, whereupon a rod pin is inserted through the holes to fasten the two building elements together. In embodiments where the side panels cover only the reinforcement section, as shown in FIG. 1, the same building elements can be used to construct any configuration at desired angles, such as 90 degree corners and straight walls, as seen in FIGS. 7 and 8. If the side panels extend the entire height of the building element, then special corner building elements may be constructed so that a section of side panel on the inside of the receiving building element corresponding to the open space may be removed to allow insertion of the extended end 20 of the adjacent building element.

In yet another embodiment, the top filler section 4 may further comprise a tongue 30 extending upward for some or all of the length of the top filler section. As shown in FIG. 4, the tongue may be in the center of the top of the top filler section. The tongue is adapted to be inserted into a matching groove or notch 32 in the bottom of the bottom filler section of the vertically-adjacent building elements.

Multiple building elements can thereby be stacked on top of each other in the same horizontal plane, instead of every other row (i.e., overlapping every row).

Figure 5:
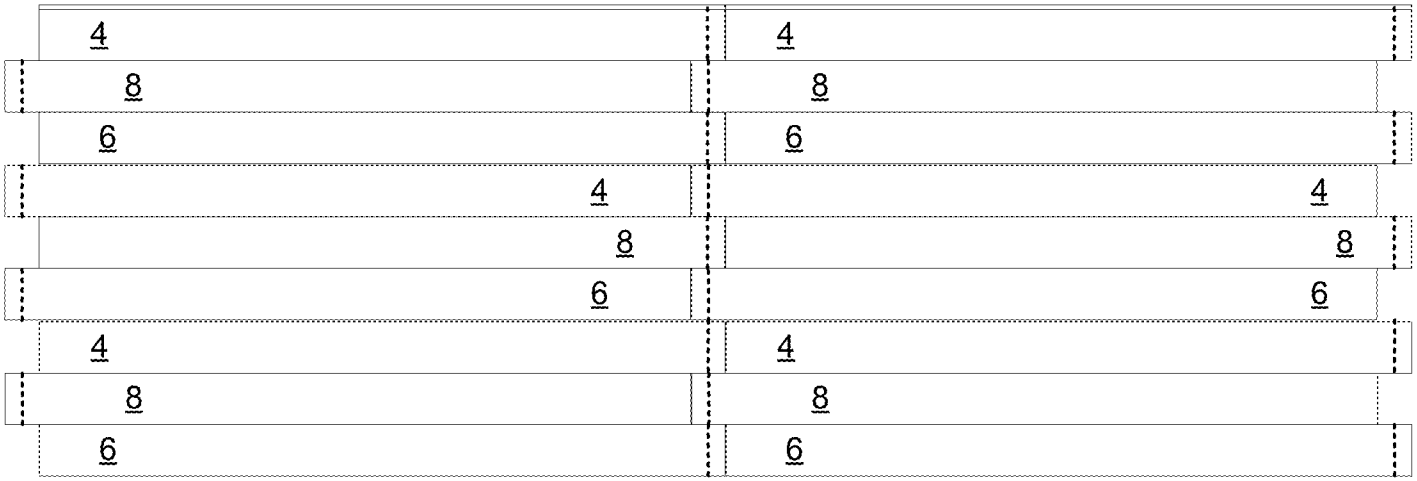
FIG. 5 shows a side view of stacked multiple building elements.

In one exemplary embodiment, the building element is 12 feet in length with 2"×4" (width×height) steel tubing as the reinforcement member. The filler sections are 4.5"×4" (width×height) sections made of wood or recycled material, and affixed to the steel tubing by bolts. The building element thus is 4.5 inches wide and 12 inches in height. The sides of the steel tubing are covered with 1.25" thick wood (or substitute) planking that matches the surfaces of the top and bottom filler sections. The steel tubing extends 4.5 inches from the end of the building element, creating a 4.5 inch notch at the opposite end. This 4.5 inch length corresponds with the 4.5 inch thickness of the building element. The building elements are then vertically stacked on top of each other with alternating ends (each element is oriented horizontally), with each corner or connection pinned using threaded rods and bolts through the pre-drilled holes, as seen in FIG. 5.

Figure 6:
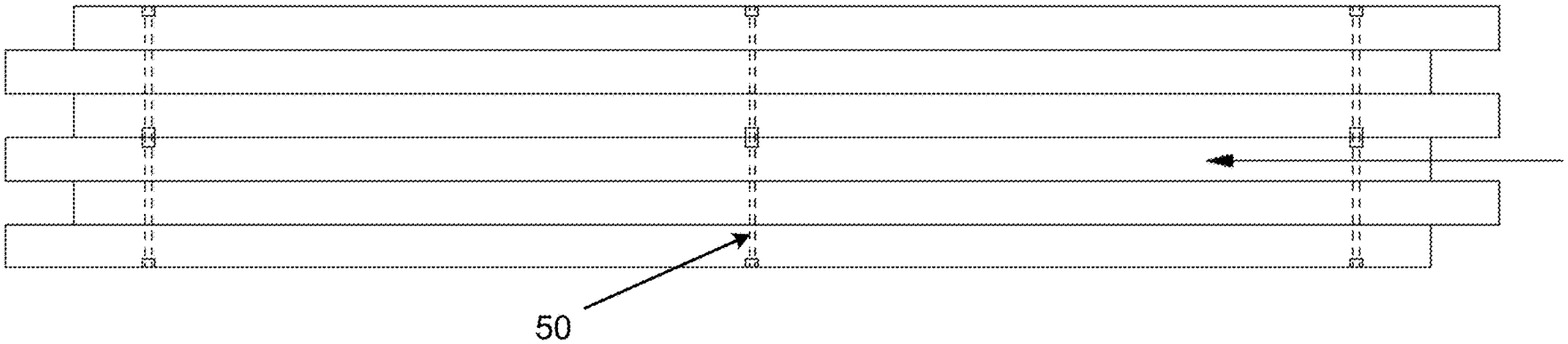
FIG. 6 shows a side view of alternative embodiment of stacked building elements.

FIG. 6 shows another embodiment with building elements alternated and stacked vertically to form part of a wall section. In several embodiments, the components of each building element may be mechanically attached vertically by rods 50 or the like at several points along the length of the element to provide additional stability and integrity for the element. Building elements, individually or as wall sections, can be attached end-to-end to form corners, as shown in FIGS. 7 and 8. Rods may be inserted in the corresponding holes, as described above, to securely connect the ends of the building elements. FIG. 8 shows a side view of a wall connected to two other walls (extending inward), which are seen by the alternating ends 58 of the corresponding elements on the other walls overlapping with the ends of the building elements of the main wall shown. One of the building elements in the wall is shaded as an example to show orientation.

Additionally, vertical holes 52 through the building elements may be located at several points along its length, so that vertical holes in stacked elements form a continuous vertical hole extending through the entire stack (or wall). As seen in FIG. 8, a reinforcement rod 60 (such as a steel or metal rod) may be inserted therein, in a similar manner as the corners, to provide stability and strength to the wall and connection between the building elements in the stack. A single rod may extend the height of the wall through all building elements. An example of a suitable rod is an ATS-SR7 "Strong-Rod" with a smooth shank and threaded ends (such as, UNC class 2A threads). In the embodiment shown, the threaded ends of each rod may be secured by a bearing plate 62 (e.g., ATS-BP7 bearing plates) or washer with a nut 64 (e.g., ATS-IN7KT isolator nut). The same rods may be used for corner attachments as well as non-corner reinforcement rods.

Figure 9:
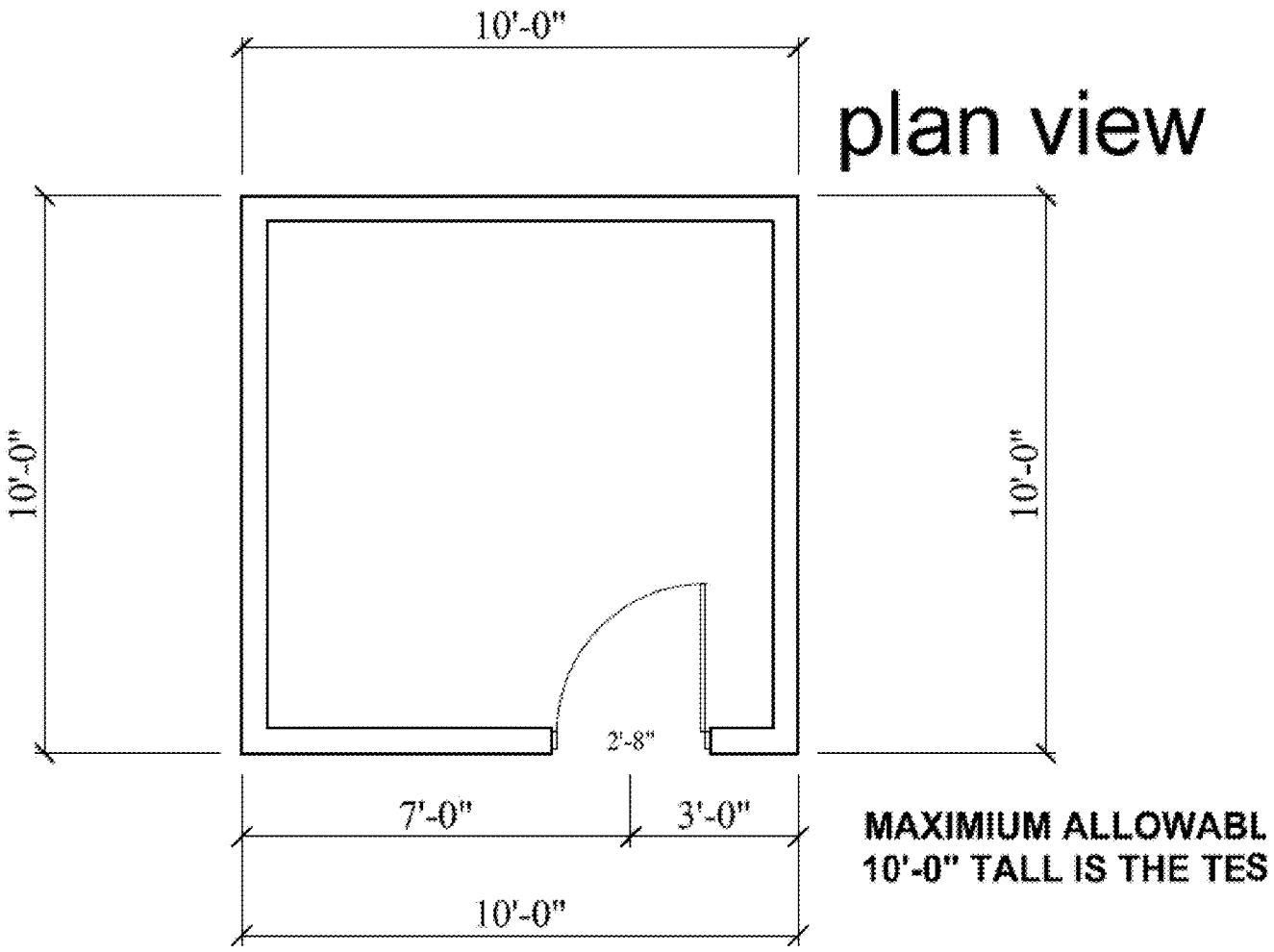
FIG. 9 shows a plan view of a structure built from combinations of the building elements.
Figure 10:
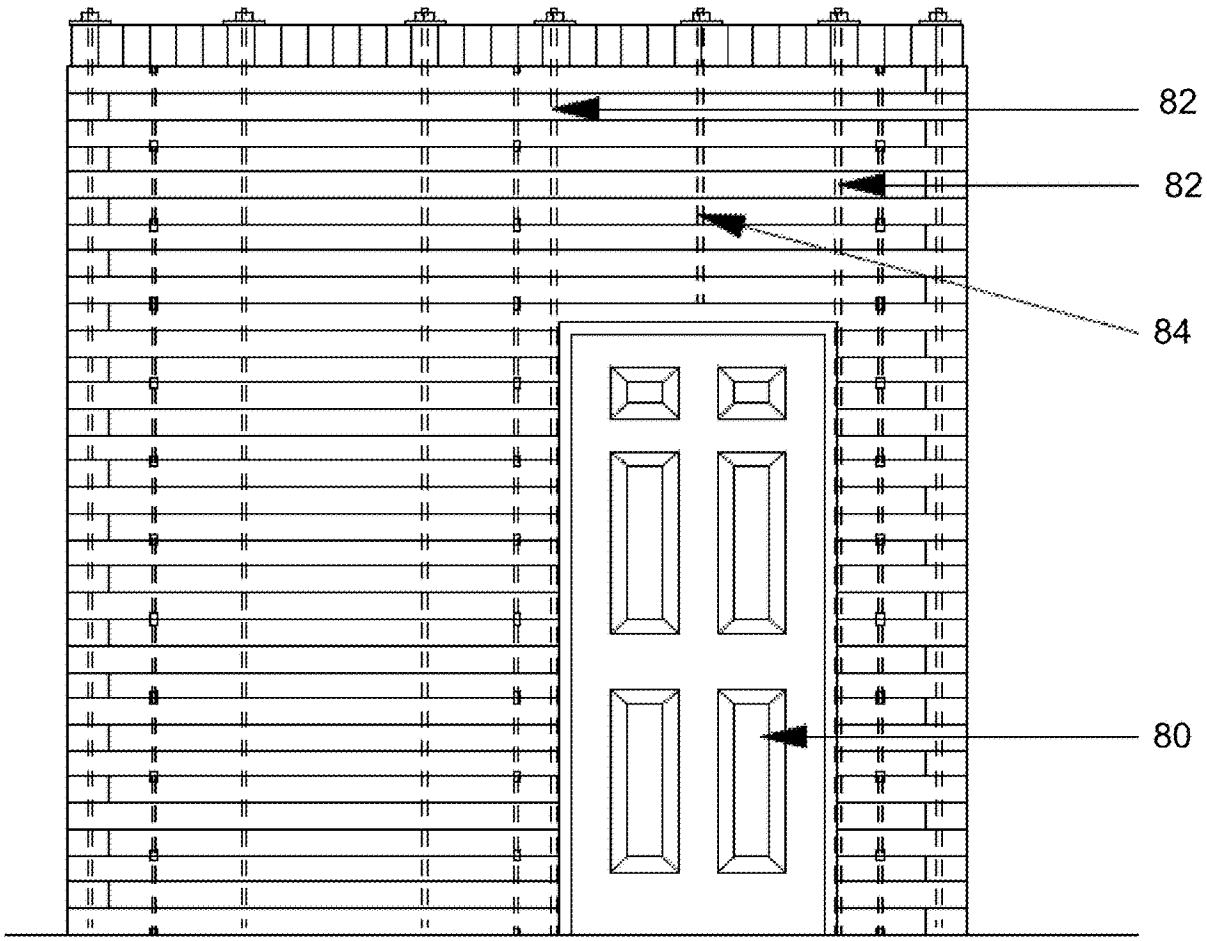
FIG. 10 shows a front wall of the structure of FIG. 9.
Figure 11:
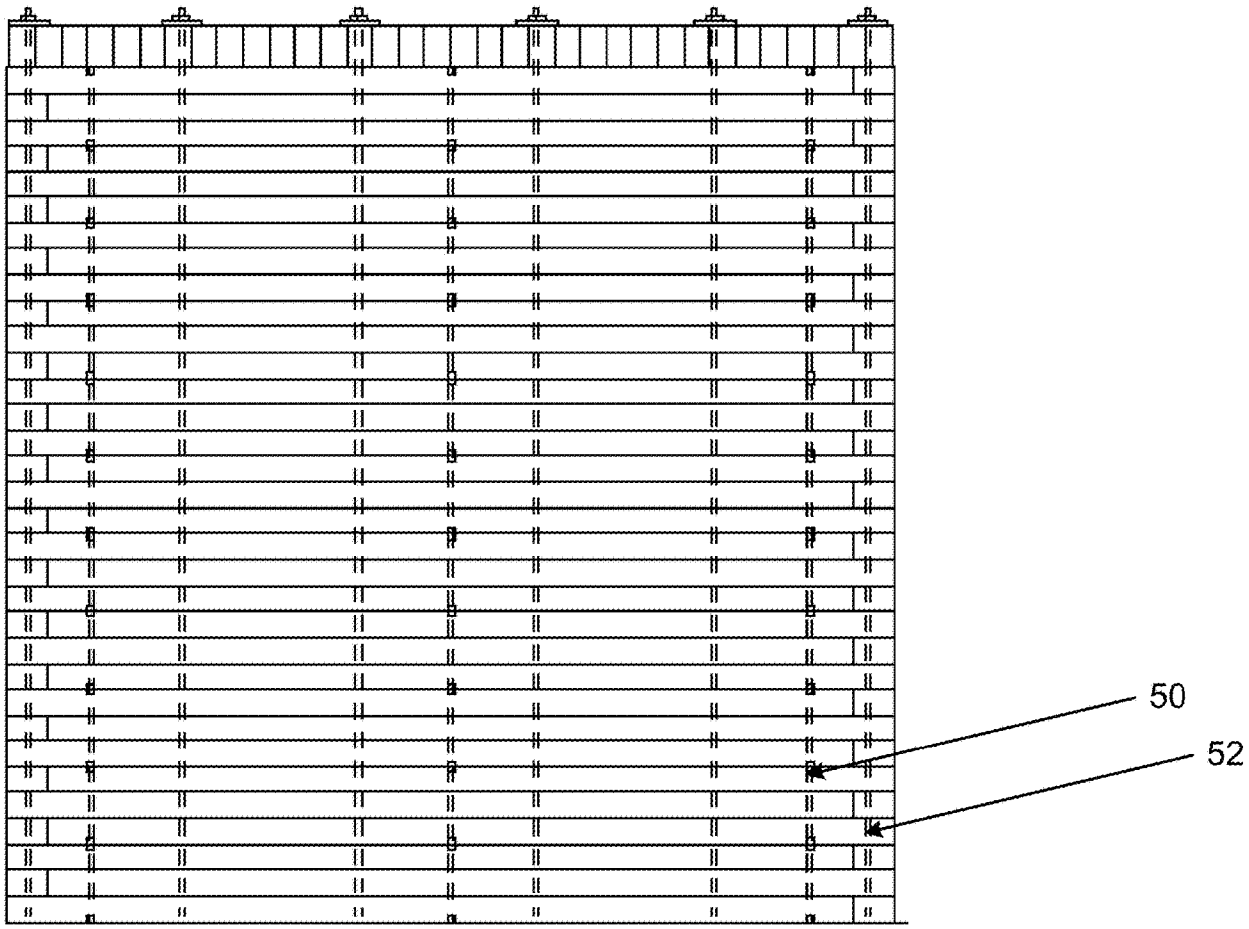
FIG. 11 shows a back wall of the structure of FIG. 9.
Figure 12:
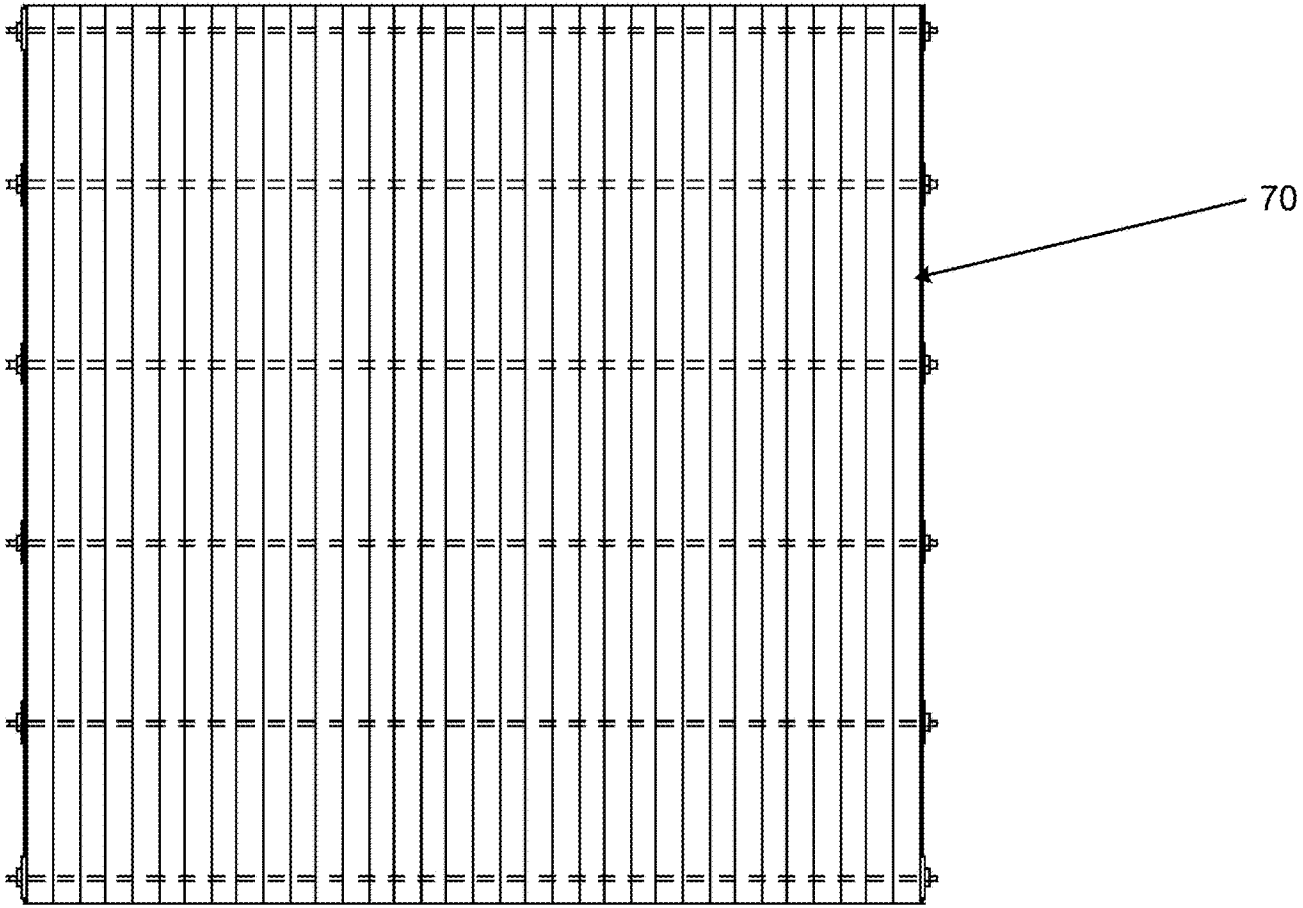
FIG. 12 shows ceiling panel of the structure of FIG. 9.

A building, shelter, or similar structure can be formed by attaching several walls of the above construction at their corners. A plan view of a square structure is shown in FIG. 9, with a front (with a door 80) and back wall shown in FIGS. 10 and 11 (the right and left sides are substantially as seen in FIG. 8). The placement of the full-wall strong rods 82 can be adjusted based on the location and width of the door 80. An additional strong rod 84 may be placed over the door assembly to provide additional structural support without breaking up the structural continuity of the wall panel. A roof or ceiling 70 may be placed across the top, and a floor or base or pad 90 may also be added. Attachment may be made by means of the "strong-rods" as described above, and as shown in FIG. 8. The roof or ceiling or floor also may be supported by reinforcement rods in a similar manner as described above, as shown in a plan view of a roof or ceiling panel in FIG. 12.

Figure 13:
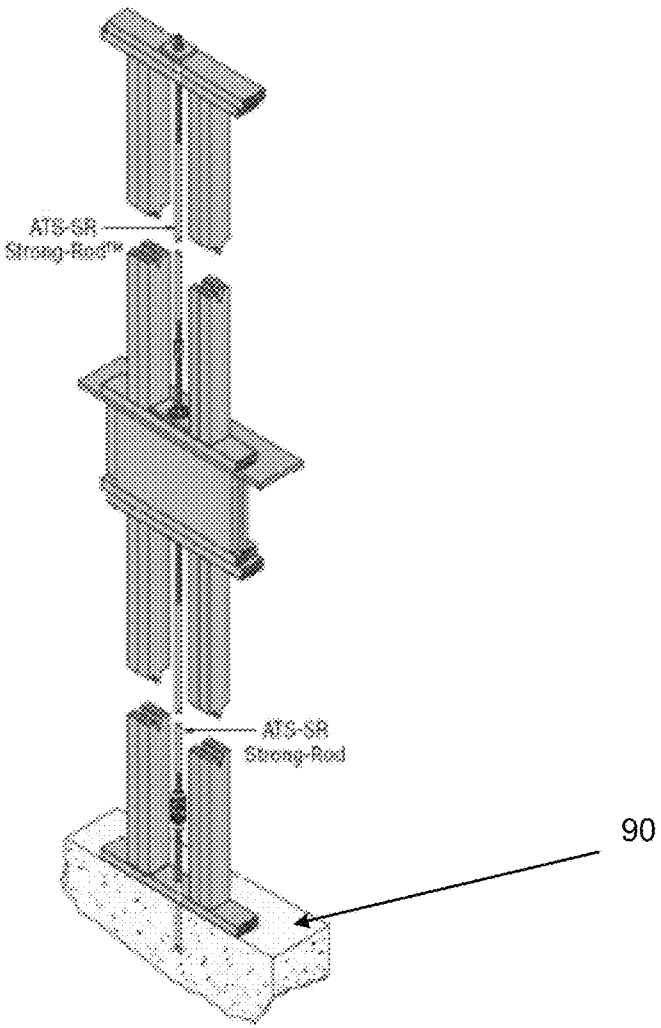
FIG. 13 shows a reinforcement rod attached to a concrete pad.

FIG. 13 shows how a strong-rod may be secured to a concrete pad or base 90 (acting as a floor for the structure) at one end, with the top end securing a ceiling panel or beam by means of a bearing plate and nut, as described above.

With the system of the present method, a building can be erected and disassembled in much less time than pre-fab or modular homes currently known in the art.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

I claim:

1. A construction system, comprising:

at least one wall comprised of a plurality of vertically-stacked building elements having a proximal end, a distal end, and a length between said proximal and distal ends, wherein said building elements are attachable end-to-end, each building element comprising an integral combination of a top member, a center member, and a bottom member, said top, center and bottom members being equal in length, wherein the center member is offset from the top and bottom members lengthwise so that the distal end of the center member extends further than the distal ends of the top and bottom members;

wherein the proximal ends of the top and bottom members each comprise a proximal vertical hole extending therethrough, and the distal end of the center member comprises a distal vertical hole extending therethrough;

further wherein each building element comprises one or more medial vertical holes extending through all three members at one or more points along the length between said proximal and distal ends;

further wherein the top member is affixed to the center member and the bottom member is affixed to the center member.

2. The system of claim 1, wherein the top and bottom members are selected from the group consisting of wood, compressed wood, wood pulp, or artificial material.

3. The system of claim 1, wherein the one or more medial vertical holes in each building element align with one or more corresponding vertical holes in vertically adjacent building elements in the wall.

4. The system of claim 3, further comprising one or more reinforcement rods extending through the one or more medial vertical holes in the vertically adjacent building elements.

5. The system of claim 1, wherein there are at least two walls.

6. The system of claim 5, further comprising a ceiling panel extending between said at least two walls.

7. The system of claim 6, further comprising a doorway located in one of said at least two walls.

8. The system of claim 1, wherein the top member further comprises a tongue extending upward for at least part of the top member length on a side of the top member opposite the center member; and wherein the bottom member further comprises a groove extending for at least part of the bottom member length on a side of the bottom member opposite the center member.

* * * * *